US005213464A

United States Patent [19]

Nicholson et al.

[11] Patent Number: 5,213,464

[45] Date of Patent: May 25, 1993

[54] METHOD AND APPARATUS FOR DISPENSING AND RETRIEVING HIGHWAY WARNING MARKERS

[75] Inventors: John P. Nicholson, Shoreview; Timothy J. Nicholson, Roseville; Eugene H. Luoma, Duluth, all of Minn.

[73] Assignee: ADDCO Manufacturing, Inc., St. Paul, Minn.

[21] Appl. No.: 769,923

[22] Filed: Sep. 30, 1991

Related U.S. Application Data

[63] Continuation-in-part of Ser. No. 468,569, Jan. 23, 1990, Pat. No. 5,054,648.

[51] Int. Cl.[5] ..... B65G 59/06

[52] U.S. Cl. ..... 414/440; 414/439; 414/523; 414/505; 414/917; 221/185; 404/9

[58] Field of Search ..... 414/434, 436, 437, 438, 414/439, 442, 441, 501, 507, 504, 505, 508, 917, 523, 528; 221/185; 198/512, 518, 624; 404/6, 9

[56] References Cited

U.S. PATENT DOCUMENTS

| | | | |
|---|---|---|---|
| 2,632,411 | 3/1953 | Cordes | 111/3 |
| 2,658,637 | 11/1953 | Bailey | 414/440 |
| 2,792,955 | 5/1957 | Sumner | 414/440 |
| 3,082,908 | 3/1963 | Ingham, Jr. | 221/11 |
| 3,096,868 | 7/1963 | Hendrikson et al. | 198/9 |
| 3,124,231 | 3/1964 | Ott, Jr. | 198/20 |
| 3,157,267 | 11/1964 | Asbury | 198/7 |
| 3,232,408 | 2/1966 | Asbury | 198/7 |
| 3,268,052 | 8/1966 | Asbury | 414/523 X |
| 3,603,479 | 9/1971 | Kuster et al. | 221/210 |
| 3,750,900 | 8/1973 | Piercey | 414/505 X |
| 3,784,037 | 1/1974 | Woodall | 414/440 |
| 4,193,512 | 3/1980 | Buxton et al. | 221/185 |
| 4,597,706 | 7/1986 | Michit | 414/505 X |
| 4,721,428 | 1/1988 | Rohrer et al. | 414/439 |
| 4,747,515 | 5/1988 | Kasher et al. | 221/116 |
| 4,792,271 | 12/1988 | Akel | 414/440 |
| 4,936,485 | 6/1990 | Downing | 221/297 |
| 4,974,990 | 12/1990 | Anderson et al. | 221/185 X |
| 5,039,273 | 8/1991 | Schuhmacher | 414/505 X |

FOREIGN PATENT DOCUMENTS 118757 6/1958 U.S.S.R. .

OTHER PUBLICATIONS

Brochure "Cone Wheel", ADDCO Manufacturing Co., Inc., 69 Empire Drive, St. Paul, Minnesota, 55103, c 1990 ADDCO.

From prior application Ser. No. 468,569, filed Jan. 23, 1990, FIGS. 1-9 and 12-16.

*Primary Examiner*—Frank E. Werner

*Attorney, Agent, or Firm*—Palmatier, Sjoquist & Helget

[57] ABSTRACT

A highway marker manipulating apparatus comprising a pair of gripper wheels spaced apart to engage and apply pressure onto the side edges of the base flange of a highway marker. The wheels are spaced apart by a loading magazine between the wheels and directing the marker flanges into gripped engagement with the gripping faces of the opposing wheels; and a guide panel between the outer portions of the wheels to guide the flanges of the markers being retrieved off the pavement. A stripper guide is provided between the wheels for urging the flanges of the markers toward the outer periphery of the wheels as the flanges are also engaging the peripherally extending guide panels as to turn the markers and move the markers along the stripper bars which carry the markers to the upper periphery of the wheels. Stabilizing guides or runners are provided to be removably mounted at the lower portion of the gripper wheels to receive the flanges of dispensed markers therebeneath for stabilizing the markers on the pavement.

9 Claims, 6 Drawing Sheets

METHOD AND APPARATUS FOR DISPENSING AND RETRIEVING HIGHWAY WARNING MARKERS

This application is a continuation-in-part of application Ser. No. 468,569, filed Jan. 23, 1990, now U.S. Pat. No. 5,054,648 by inventor Eugene H. Luoma.

BACKGROUND OF THE INVENTION

In the maintenance of roads and highways, there is a need to have warning markers placed on the highways for warning traffic away from dangerous areas and work under construction. Oftentimes marker cones with flat bases are used, and these cones have been traditionally placed on the highway by a man standing on a platform on the back end of a truck and then placing these warning markers on the highway pavement or surface as the truck travels along the highway. They have been picked up in a similar way with a man standing on the platform, and simply reaching down and picking up the markers as the truck passes along the line of markers. Obviously, this technique is a dangerous practice, endangering the man picking them up and placing them on the highway.

During hot weather, such highway markers oftentimes become soft and very pliable, particularly in the nose or cone portions of the markers, so that handling of these markers oftentimes becomes somewhat difficult.

SUMMARY OF THE INVENTION

An object of the invention is to provide an improved apparatus on a highway truck for safely and alternately dispensing and retrieving highway warning markers at high speeds of 15 to 20 miles per hour.

A feature of the invention is a pair of revolving gripper wheels traveling along the highway for gripping the base flanges of such warning markers, and positioning apparatus for tipping and orienting markers, and guiding the upright flanges into the gripping space between the wheels for engagement and gripping by the wheels. The marker flanges are gripped by portions of the wheel faces between the outer periphery and the wheel centers. Stationary spiral camming stripper bars extend upwardly from the central portion of the wheel faces and forwardly along the wheel faces to the top edge of the wheel periphery. The marker flanges will move along the stripper bars with the cone noses extending downwardly. The cones may then be lifted off the stripper bars.

The revolving gripper wheels are slightly cone-shaped, diverging from each other from their central portions and toward their outer peripheries; and the marker wheels are widely spaced from each other to engage the edges of the base flanges of the warning markers. The cone-shaped wheel faces grip the marker base flanges over a wide gripping zone extending from the edges of the wheels and partly inwardly toward the wheel centers.

The gripper wheel faces, at the inner portions of the gripping zones, firmly grip and often bend the adjacent portions of the marker base flanges; and the wheel faces, at the outer portions of the gripping zones adjacent the wheel edges, grip the base flanges more lightly. The firm gripping of the flange assures lifting of the marker; and then as the spiral stripper bars urge the marker flange toward the edge of the revolving wheel, the lighter gripping of the flange allows the marker to turn as to orient the nose of the marker downwardly as the wheels move the marker along the stripper bars.

Another feature of the invention is the method of handling highway warning markers for dispensing and retrieving such markers. The markers are handled by squeezing opposite edge portions of the base flanges of the members toward each other, thereby gripping the marker for manipulation. Portions of such edges may be lightly gripped in retrieving markers for moving the flanges along stripper bars during retrieving of the markers. Similarly, the edges may be lightly gripped in dispensing such markers, steering the flanges downwardly toward the pavement and beneath the front ends of stabilizing guides which travel above the pavement and pass over the base flanges to stabilize the markers on the highway surface.

Portions of such edges may be very firmly gripped for lifting the markers from the pavement. After the markers are lifted, the grip is loosened to permit the markers to be turned so that the nose portions of the markers extend downwardly from the flange.

Another feature of the invention is a scoop-shaped guide between the edge portions of the wheels to engage and confine a marker being gripped, lifted, and guided as the wheels and stripper bars manipulate the marker. The lower portion of the scoop-shaped guide extends downwardly very close to the pavement, and is tiltable upwardly to be out of the way during dispensing operations.

In another feature of the invention, the dispensing magazine extends into the outer peripheral portion of flange conveying space between the wheels. The marker base flanges will be lightly gripped by the outer portion of the gripping zone on the faces of the wheels. The wheels direct the flanges toward the pavement and beneath the upwardly curved front ends of the marker stabilizing guides which assist in standing the markers upon their base flanges. The stabilizing guides are removable for converting the apparatus to the marker retrieving mode of operation.

Still another feature of the invention is the mounting of the revolving gripper wheels used in dispensing and retrieving of the markers. A parallelogram articulated frame connects the wheels to a mounting on the bed of a highway truck. A hydraulic cylinder within the articulated frame serves to lift the wheel to the height of the truck bed. The mounting then moves the wheels tranversely over the truck bend for transport. The mounting also has a simple demountable attachment to the articulated frame and permits locating the wheels and articulated frame on either the left side or the right side of the truck bed.

DETAILED SPECIFICATION

Figure 1:
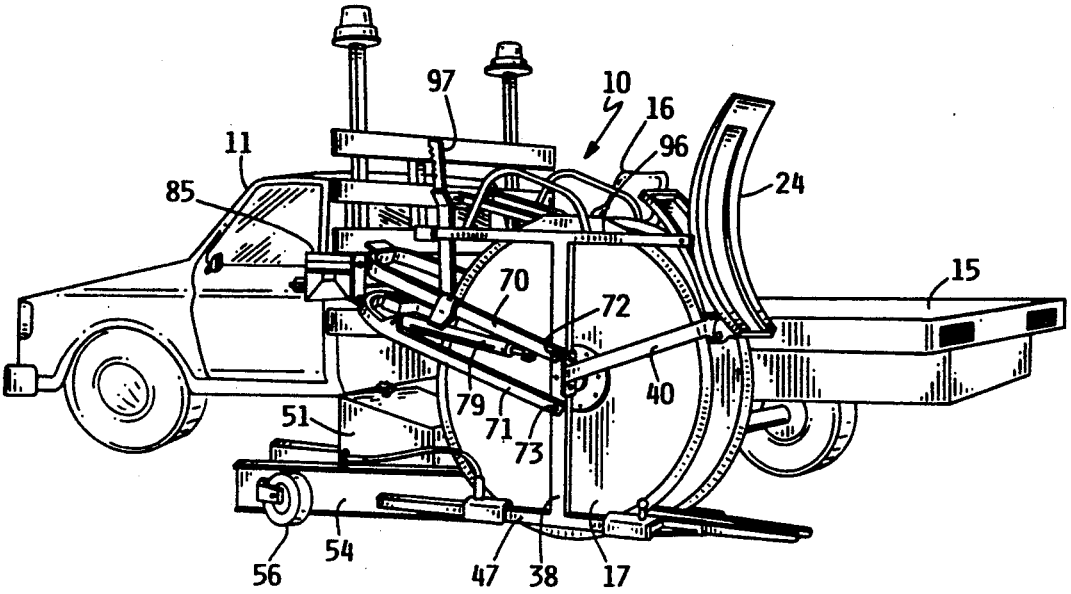
FIG. 1 is a perspective view of the apparatus viewed from the rear in the marker dispensing mode.

One form of the highway warning marker dispensing and retrieving apparatus is shown in the drawings and is indicated in general by the numeral 10.

Figure 2:
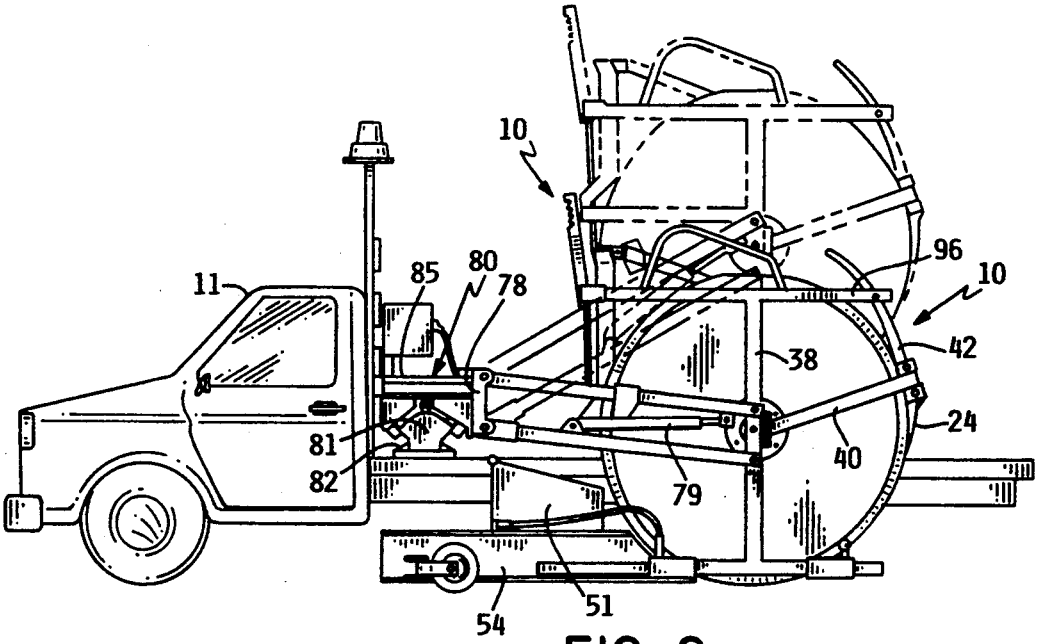
FIG. 2 is a perspective view of the apparatus viewed directly from the side and in the marker retrieving mode.
Figure 3:
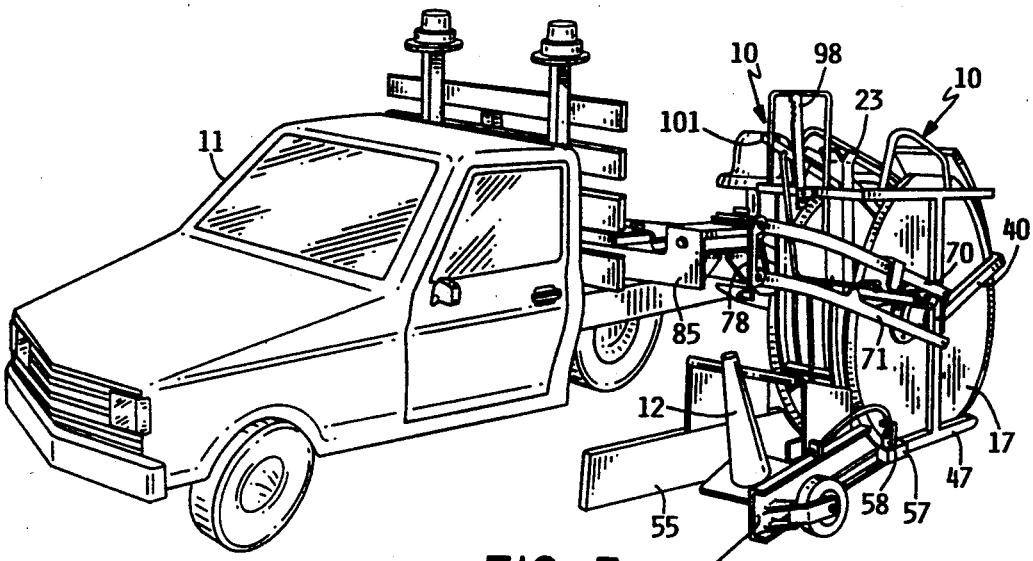
FIG. 3 is a perspective view of the apparatus viewed from the front and illustrating the apparatus in a marker retrieving mode.

The apparatus is shown in the marker-retrieving mode in FIGS. 1 and 2, and is shown in the dispensing mode in FIG. 3.

The apparatus 10 is to be mounted upon a highway truck 11 to move rapidly along the highway pavement at speeds of 15 to 20 mph for the purpose of dispensing and retrieving plastic molded highway warning markers which have stiff base flanges 13 and upstanding cone or nose portions 14. The nose portion 14 and the base flange 13 are usually formed integrally of each other, but not necessarily so.

It will be recognized that the truck 11 has a bed or box 15 to which the marker dispensing and retrieving apparatus 10 is attached; and a chair 16 is provided on the truck bed for a workman who feeds highway markers 12 into the apparatus 10 when a dispensing operation is being carried out; and the workman removes the markers 12 being retrieved during a marker retrieval operation.

Figure 4:
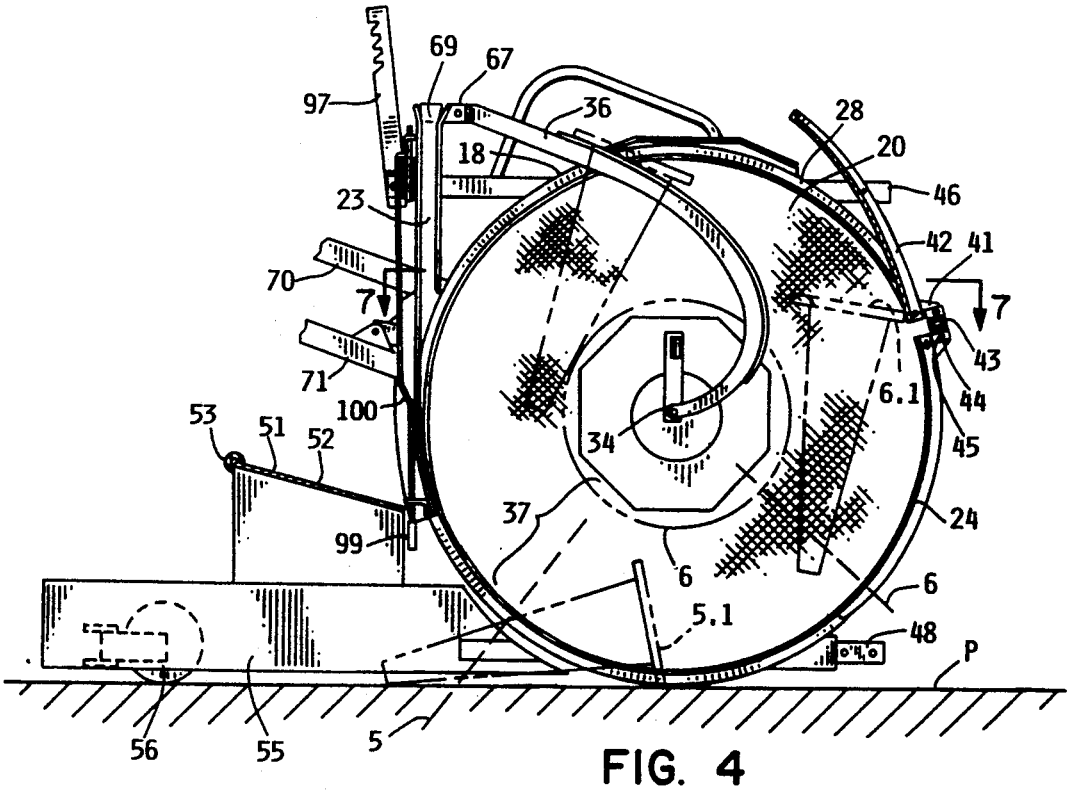
FIG. 4 is a detailed section view illustrating the inner face of one of the wheels and related apparatus, and taken approximately at 4—4 as seen in FIG. 7.
Figure 7:
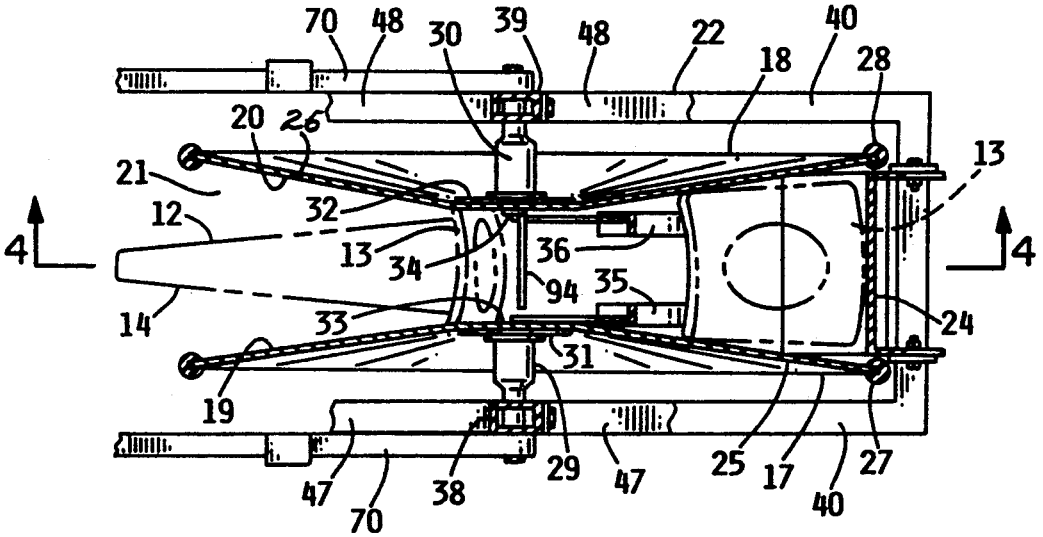
FIG. 7 is a detailed section view taken approximately at 7—7 of FIG. 4 with certain background structure eliminated.

The marker dispensing and retrieving apparatus 10 includes a pair of gripper wheels 17 and 18 having gripping faces 19 and 20 respectively confronting each other in spaced relation as to define a marker conveying space 21 therebetween. Although the width of the marker conveying space between the wheels 17 and 18 may vary somewhat because of the slightly conical shape of the gripper faces 19, 20, the width of the marker conveying space 21 substantially equals the edge-to-edge width of the base flange 13 of the markers being handled. The spacing between the gripper faces 19, 20 is substantially greater than the diameter of the body portion or cone portions 14 of the markers 12; and the spacing between the gripper wheels 17 and 18 is established and maintained by the frame means, indicated in general by numeral 22. The width of the marker conveying space 21 is, at its widest portions, approximately the same as the width of the loading magazine 23 which extends into the marker conveying space 21 between the outer edges of the wheels 17, 18 and guides the flanges of markers being loaded into the gripper wheels into outer peripheral portions of the wheels, substantially in the position of the marker illustrated in FIG. 7; and the width of the marker conveying space 21 is also substantially the same as the width of the scoop-shaped guide or guide panel 24 which also extends between the outer edges of the wheels 17, 18 and engages the edges of flanges of markers being lifted off the pavement and guides those flanges as they travel upwardly, substantially as seen in FIG. 4.

The gripping faces 19, 20 of the gripper wheels 17, 18 have rubber-like faces providing a high coefficient of friction for engaging and gripping the edges of the marker flanges without allowing the flanges to slip after they engage the inner faces of the gripper wheels.

The wheels 17, 18 have substantially rigid backing panels 25, 26, circular in shape and slightly conical in configuration, and providing a backing and mounting for the gripping faces 19, 20. The wheels 17, 18 also have rubber tires 27, 28 which are mounted on the circular edge portions of the rim portions of the panels 25, 26; and the tires 27, 28 will roll directly on the highway surface or pavement P.

Each of the wheels 17, 18 is individually mounted on its own fixed cantilever stationary mounting post 29, 30; and it will be noted that there is no axle extending between the wheels 17, 18 at their center. Each of the wheels has a bearing hub 31, 32 providing a connection between the mounting posts 29, 30 and the apex portions of the slightly conically-shaped mounting panels 25, 26. Retaining screws or fasteners secure the wheels and mounting hubs 33, 34 to the center posts 29, 30, and also provide mounting attachments or anchors for the inner ends of spiral stripper bars 35, 36.

On the gripping faces 19, 20 of the wheels 17, 18, the faces will grip the edges of the flanges 13 over a fairly wide zone indicated in FIG. 4 by the numeral 37, which has a width of approximately one-third to one-half the radius of the wheels 17, 18. The width of the marker conveying space 21 between the wheels varies considerably over the width of the gripping zone 37, so that the portions of the flanges 13 of the markers 12 will be flexed to a considerably greater degree adjacent the inner portions of the gripping zones 37 than adjacent the outer portions of the zones 37 and the wheels adjacent the tires 27, 28.

Figure 5:
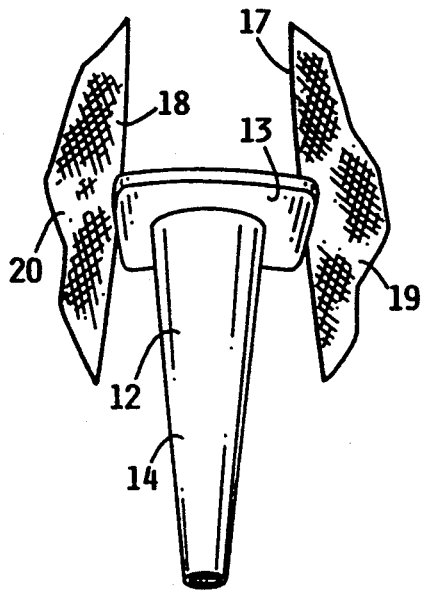
FIG. 5 is a detailed plan view of a highway marker as it is initially being engaged during a retrieving operation, substantially in the position of the marker indicated by numeral 5.1 and illustrated in phantom lines in FIG. 4.
Figure 6:
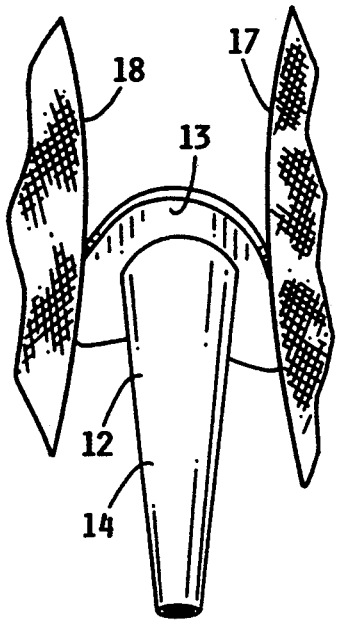
FIG. 6 is a detailed elevation view of one of the markers fully engaged with the gripper wheels and in the position of a marker indicated by numeral 6.1 and shown in phantom lines in FIG. 4.

FIG. 6 illustrates the greater flexing of the flange 13 adjacent the inner portion of the gripping zone 37 than the flexing at the outer portion of the zone as illustrated in FIG. 5.

The central portions of the faces 19, 20 beween the gripping zone 37 and the central axes of the wheels will not engage the base flanges at all.

The frame portion 22 of the apparatus specifically includes substantially upright frame members 38, 39 adjacent wheels 17 and 18 respectively, and extending substantially throughout their full height. The upright frame members 38, 39 have the wheel mounting posts 29, 30 affixed thereto as by bolts and will maintain the spacing between the two wheels 17, 18.

The frame portion 22 also includes a generally U-shaped frame member 40 including a cross portion 41 generally embracing the rear sides of wheels 17, and 18. The frame portions 40, 41 extend around the wheels and mount the guide panel 24 and also an additional upper portion 42 of the guide panel, which also extends peripherally around a portion of the gripper wheels 17, 18 and between the outer edge portions thereof.

The cross frame 41 carries mounting ears 43 and pivot pins 44 upon which mounting ears 45 of the guide panel 24 is mounted. With this arrangement, the guide panel 24 is swingable from the closed position, for use in the retrieval mode of the apparatus, to its open or upper position illustrated in FIG. 3 to adapt the apparatus 10 for the dispensing mode of operation.

A latch 46 is provided on the upper guide panel portion 42 to retain the lower swingable guide panel 24 in its upwardly swung position during the dispensing mode of operation.

The frame portion 22 also includes horizontal base portions 47, 48 which extend substantially horizontally forwardly and rearwardly of the vertical frame elements 38, 39. The base portions 47, 48 extend rearwardly along the pavement and along the lower portions of the gripper wheels 17, 18 for mounting a pair of marker stabilizing guides 49, 50.

The base portions 47, 48 of the frame portion also extend forwardly from the upright frame elements 38, 39 for removably mounting opposite side portions of the in-feed chute 51 at the forward side of the gripper wheels 17, 18.

The in-feed chute 51 includes a top panel 52, the padded front edge 53 thereof forming a bumper to engage and tip over highway markers, substantially as illustrated in FIG. 1, as the apparatus 10 moves forwardly along the pavement with the truck 11. The in-feed chute 51 also includes a pair of side panels 54, 55, each supported by a small ground wheel 56. The panels 54, 55, together with the top panel 52, orient the highway warning markers 12 so that they will lie on their sides with their nose portions or cone portions 14 oriented in a forward direction relative to the direction of travel of the apparatus 10. The in-feed chute 51 is mounted on the horizontal base portions 47, 48 of the frame by a pair of sleeves 57 which have latches 58 detachably securing the sleeves to the base portions 47, 48 of the frame.

The marker stabilizing guides 49, 50 comprise elongate runners or bars having mounting brackets 59, 60 detachably secured by mounting sleeves 61, 62 to the ends of the base portions 47, 48 of the frame and releasably attached thereto by latches 63, 64. The front end portions 65, 66 of the stabilizing bars or runners 49, 50, are curved upwardly to receive the marker flanges 13 therebeneath. It will be recognized that the guides or runners 49, 50 pass over the top of the marker flanges as the flanges rest upon the highway pavement and thereby stabilize the markers in upright position.

The spiral stripper bars 35, 36 are generally cam-shaped and extend upwardly from the stationary center hubs 33, 34 and thence forwardly across the the gripping zones 37 of the wheel faces; and the front ends of the stripper bars 35, 36 are affixed to frame portions 67 provided at the upper portions of the loading magazine 23. The flange engaging surfaces of the stripper bars 36 may be covered with a slippery nylon lamina or other suitable material.

The loading magazine 23 is formed of a pair of spaced and confronting angle bars 68, 69, spaced from each other by approximately the width of the marker flanges 13; and the angle bars of the magazine 23 may also be covered with nylon laminae or inserts 69.1 to allow the base flanges of the markers to freely slide along the magazines in a downward direction for loading into the outer portions of the gripper faces 19, 20 to be temporarily and lightly gripped by the wheels as the flanges are directed downwardly to pass beneath the upturned front ends 65, 66 of the stabilizing bars or runners 49, 50. The loading magazine is affixed to the frame means 22 by frame elements 96 which are affixed to the upright frame elements 38, 39.

The frame means or frame portion 22 also includes a pair of parallel frame arms 70, 71, each of which is generally U-shaped to extend forwardly around the front edges of the gripper wheels 17, 18 and rearwardly to the upright frame members 38, 39 to which each of the frame arms 70, 71 is pivotally connected as by connector bolts 72, 73. The U-shaped front ends of the frame arms 70, 71 are provided with mounting brackets 74, 75, each of which is pivotally connected by mounting bolts 76, 77 to a mounting bracket 78.

The parallel frame arms 70, 71 are interconnected by a pair of hydraulic cylinders 79, one at each side of the U-shaped frame arms at each side of the pair of wheels 17, 18; and the hydraulic cylinders have their cylinder ends pivoted to the lower frame arm and the piston rod pivoted to the upper frame arm for the purpose of lifting the frame arms and the gripper wheels 17, 18 when the hydraulic cylinders are extended. The hydraulic cylinders are connected to a suitable hydraulic pump system provided on the truck for the purpose of operating the mechanism 10.

Figure 11:
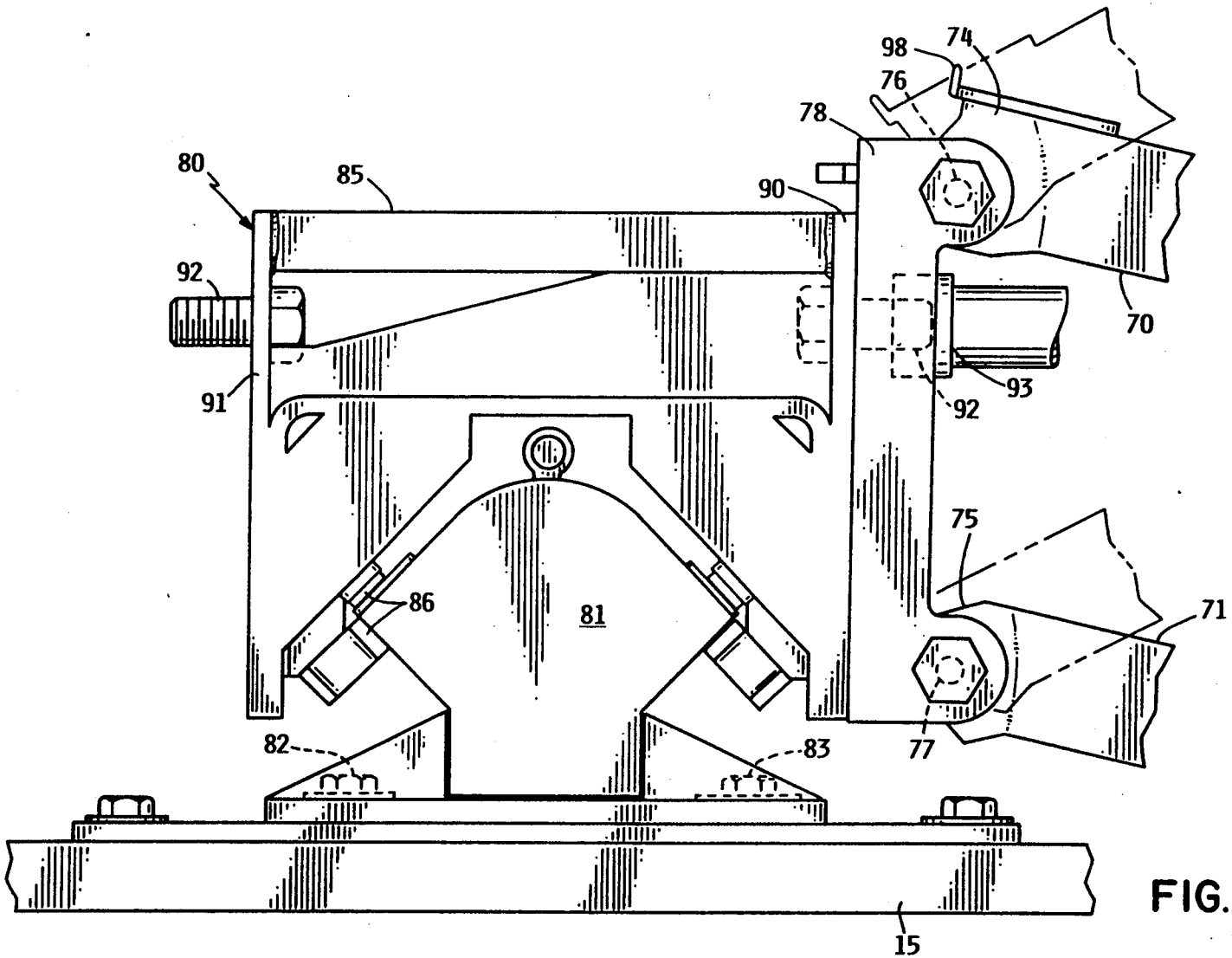
FIG. 11 is a detailed elevation view of a portion of the frame portions and anchoring apparatus on the bed of a highway truck.
Figure 12:
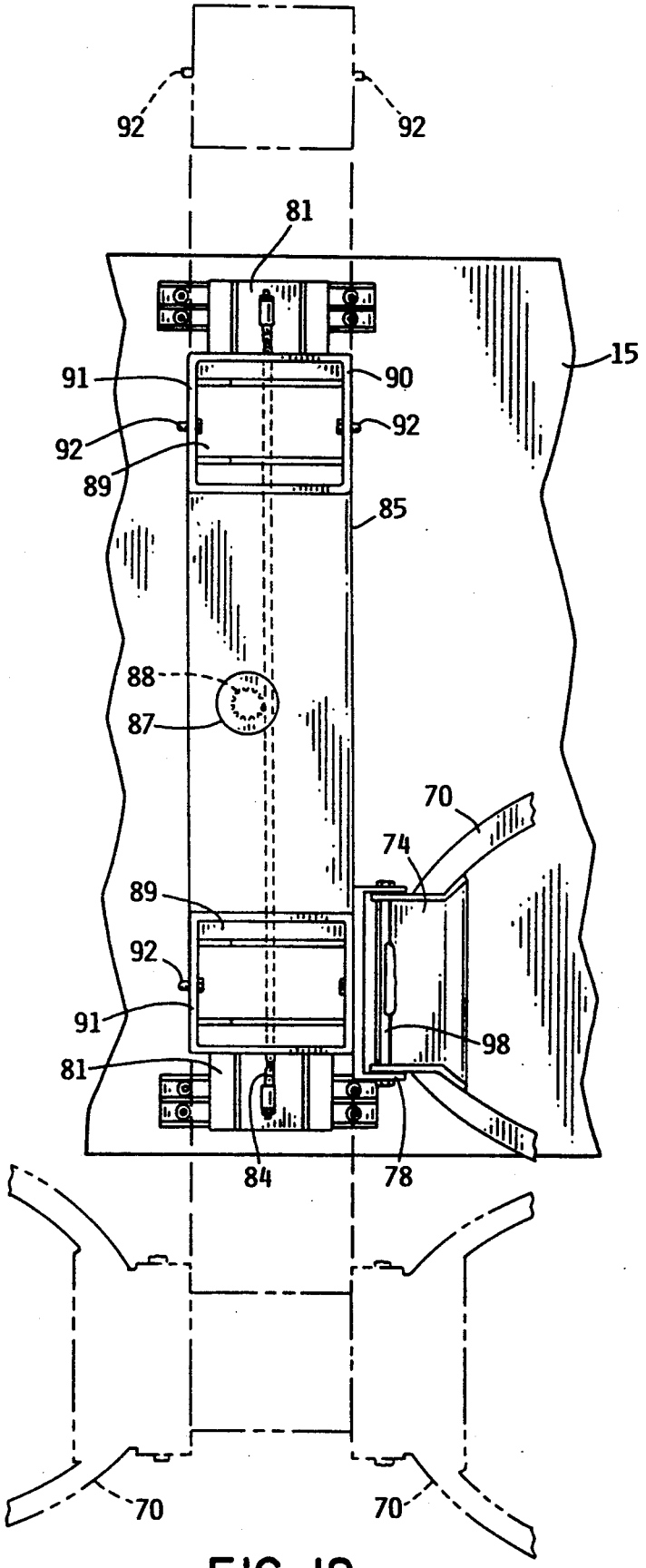
FIG. 12 is a detailed top plan view showing the anchoring apparatus and certain frame portions related to the bed of a highway truck.

The frame bracket 78 provides connection to the anchoring means or anchoring portion indicated in general by numeral 80 and mounted on the truck bed 15. The anchoring means includes a rigid track 81 having mounting bases 82 affixed by mounting bolts 83 to the bed of the truck. The track 81 is seen in FIG. 11 to extend substantially across the width of the truck bed 15 so that the ends of the track are immediately adjacent the sides of the truck bed. The track 81 has a roller chain 84 affixed to its upper surface and extending along the full length of the track.

A carriage 85 forms a portion of the anchoring means or anchoring portion 80 and is movable along the track 81 on its guide wheels 86. The carriage 85 includes a hydraulic motor 87 which drives a sprocket connection 88 meshed with the roller chain 84 for the purpose of propelling the carriage 85 in either direction along the track 81.

The carriage 85 is rigidly formed of steel and is reinforced in a number of interlocking relationships to be able to mount the entire apparatus 10 including gripping wheels 17, 18 and the frame means 22 illustrated in FIGS. 1–3. At each end of the carriage 85, attaching means or portions 89 are provided to which the mounting bracket 78 of the frame is to be attached. Each of the attachment portions 89 has a pair of rigid mounting plates 90, 91 forming a part thereof. The plates 90 face rearwardly along the truck bed 15 and the plates 91 face forwardly along the truck. Each of the mounting plates has a heavy threaded mounting stud 92 affixed thereon for the purpose of mounting the bracket 78. The bracket 78 has a large aperture therein to receive the stud 92 therethrough; and a when the stud protrudes through the aperture in the bracket 78, a nut 93 is screwed onto the threaded stud to removably secure the bracket 78 to the anchoring means 80.

In ordinary use, the carriage 85 is extended outwardly beyond the edge of the truck bed 15 and the parallel frame arms 70, 71 extend rearwardly therefrom, substantially as illustrated in FIGS. 1–3 and 11. The gripper wheels 17, 18 may be lifted off the pavement and to the level of the truck bed by extending the hydraulic cylinders 79, and when the gripper wheels 17, 18 have been lifted to the height of the truck bed, the hydraulic motor 87 is operated to move the carriage 85 and the frame arms 70, 71 and the gripper wheels 17, 18 over the truck bed, whereupon when the gripper wheels 17, 18 have been placed over the truck bed, the hydraulic cylinders 79 will be retracted again to lower the gripper wheels onto the truck bed for transport to a new location.

Figure 8:
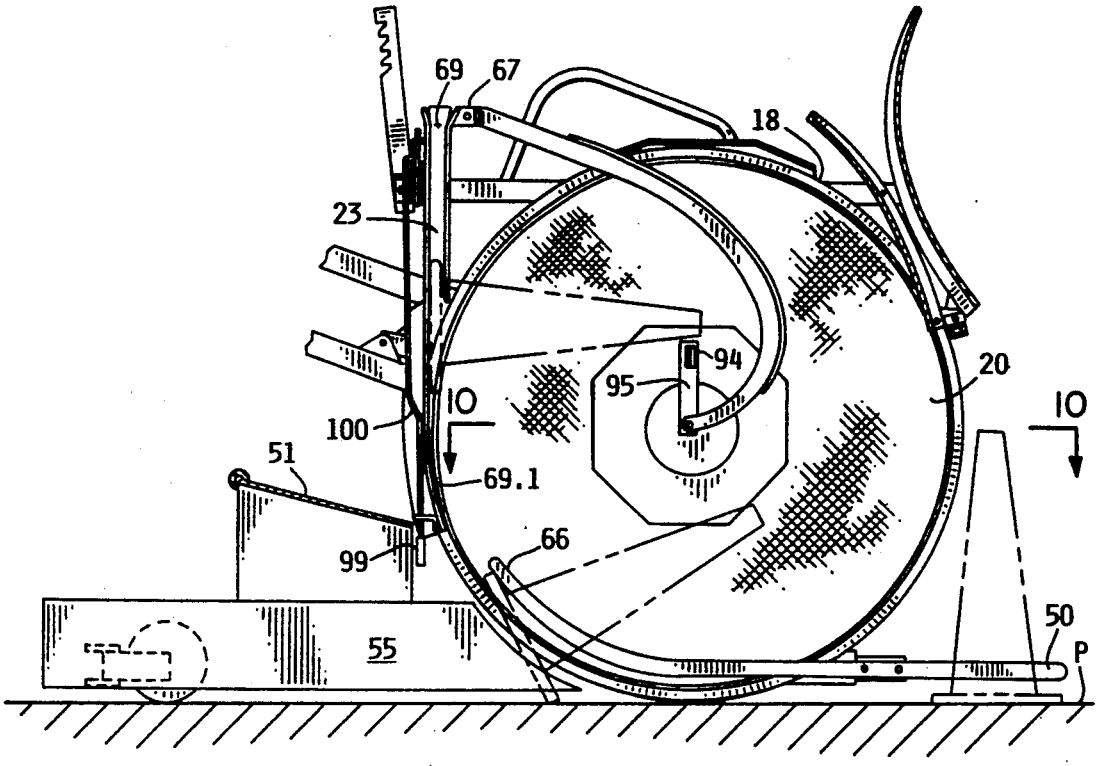
FIG. 8 is a detailed section view illustrating one of the gripper wheels and related apparatus in section and in the cone dispensing mode, and taken approximately at 8—8 of FIG. 9.
Figure 9:
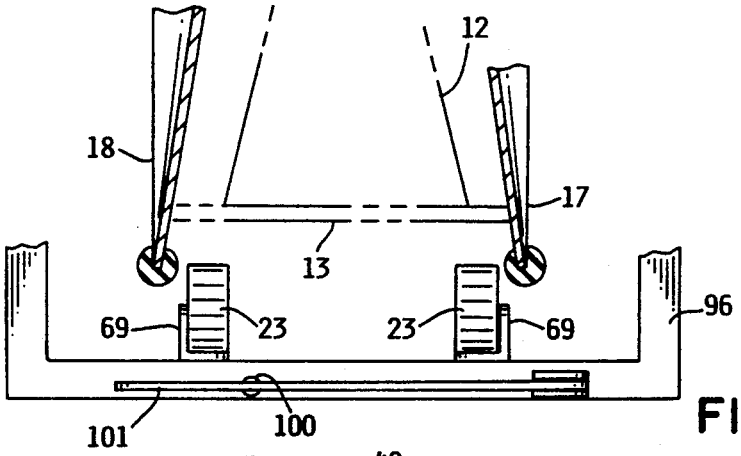
FIG. 9 is a detailed top plan view of the loading magazine and adjacent portions of the gripper wheels.
Figure 10:
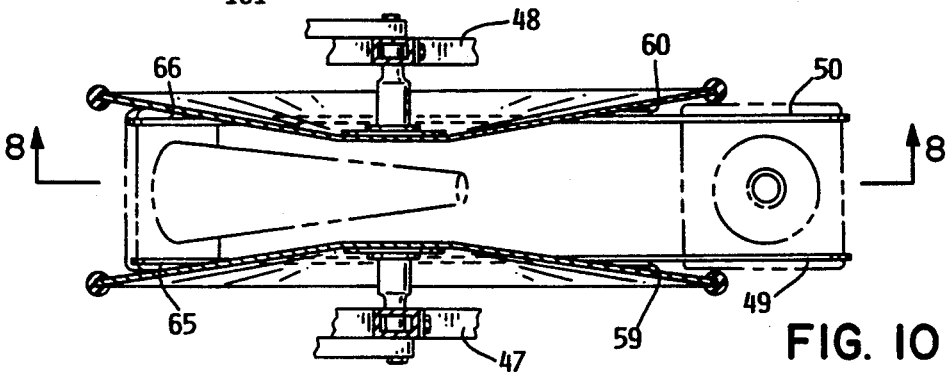
FIG. 10 is a detailed section view illustrating the gripper wheels and related apparatus in a dispensing mode and taken approximately at 9—9 of FIG. 8.

In the orindary course of operating the dispensing and retrieving apparatus, the apparatus may be first adapted to the dispensing mode or the retrieving mode. When the apparatus is adapted to the dispensing mode, the lower portion 24 of the scoop-shaped guiding panel is swung upwardly and attached by latch 46 in the upwardly swung position. A workman sitting adjacent the apparatus 10 on the truck bed will feed highway markers into the magazine as the truck travels along the highway causing the wheels 17, 18 to roll on the pavement, substantially in the manner illustrated in FIG. 8. The highway markers are substantially horizontal when guided through the magazine 23. As the markers are dropped down the magazine, the base flange 13 will be momentarily gripped and guided by the gripping faces of the wheels which are rolling along the pavement, and the flange of the marker will pass below the upturned ends 65, 66 of the stabilizing guides 49, 50 and then the guides will pass over the flange so as to stabilize the marker in upright position.

In the event the marker has a relatively long nose or cone portion 14, the nose portion thereof may engage a bumper or bar 94 affixed on an upright frame element 95 at the inner end of the stripper bar so that the nose portion of the marker is momentarily restrained while the marker is falling beneath the guides 65, 66. Bar 94 is hinged as to be movable out of the way for some operations. Depending upon how fast the truck is operated and the speed with which the workman can feed markers into the magazine, the markers may be placed on the highway at approximately 15 to 20 feet apart, or any other suitable space as desired.

Ordinarly, when the markers are already on the pavement, they will be generally in a line so that the truck may be driven along at one side of the line of markers and the markers can be readily retrieved by the apparatus 10.

In establishing the retrieval mode of the apparatus, the stabilizing bars 49, 50 are removed from the frame simply by sliding the sleeves 61, 62 from the frame portions 47, 48. It is important during the retrieval mode that the in-feed chute 51 be in place. The lower portion of the scoop-shaped guide panel 24 is lowered into the position illustrated in FIG. 4 and is latched in that closed position.

As the truck is driven along the line of highway warning markers 12, most of the markers will be standing upright, but some of the markers may be lying on their side due to wind conditions and other influences. The markers that are lying on their side will be manipulated by the side panels 54, 55 of the in-feed chute 51 so that the nose portions of the markers will face in a forward direction and the flanges 13 will be oriented substantially transversely to the direction of travel and transversely to the orientation of the gripper wheels 17, 18, and their gripper faces 19, 20. The upright markers will be engaged by the bumper 53 and tipped onto their sides with the marker noses 14 extending forwardly and the flanges oriented transversely to the direction of travel. The rolling gripper wheels will roll onto the flanges of the highway markers and the gripping faces 19, 20 of the wheels will engage and grip the edges of the flanges within the zone 37 on the gripper faces. Initially, the flanges of the markers will be bent only slightly by the gripper faces of the wheels rolling onto the flanges, but as the wheels become fully engaged with the flanges, the flanges bow considerably, substantially as illustrated in FIG. 6.

As the wheels roll over the markers, pressure is applied onto the edge portions of the flanges, causing the bowing and bending. Accordingly, the side edges of the flange are gripped tightly, and the marker as a whole, will be lifted upwardly by the revolving wheel, substantially into the phantom line position 6.1 illustrated in FIG. 4.

As the marker is lifted by the revolving gripper wheels 17, 18, one edge portion of the base flange 13 will slide along the guide panel 24 which is disposed slightly inwardly of the tires 28. The guide panel 24 assures that the marker stays between the gripper wheels 17, 18. Soon after the flange of the marker engages the guide panel 24, another opposite edge portion of the base flange 13 engages the two cam-shaped stripper bars 35, 36. With the combined influence of the gripper wheels 17, 18 causing continued movement of the marker, together with the influence of the stripper bars 35, 36 and the guide panels 24 and then 42, the marker will turn so that the base flange will ride flush along the stripper bars 35, 36. As this occurs, the flange is continuing to be propelled by the gripper faces 19, 20 of the wheels 17, 18 until the entire marker reaches the extreme upper portion of the stripper bars 55, 56 which traverse the outer edge portion of the wheels. The workman will then lift the marker from the stripper bars and place the marker in a nearby area on the truck bed.

It will be noted that the retrieval operation may proceed at a rate of 15 to 20 mph, picking up cones very rapidly and delivering them onto the stripper bars for collection on the truck bed.

It will be noted that a portion of the frame includes a horizontal frame bar 96 affixed as by welding to the upright frame elements 38, 39. The frame bars 96 at opposite sides of the frame both connect to the guide panel 42 and extend forwardly to connect to the dispensing magazine. A swingable notched bar or releasable support 97 is secured to the front portion of the frame bar 96 and may be swung downwardly so that the one of its notches will attach to a rigid lip or flange 98 on the bracket 74 of the upper frame arms 70. The connection provided by the notched bar 97 between the frame 96 and the frame arms 70, 71, is useful when the bracket 78 is detached from the carriage 85 for the purpose of positioning the marker manipulating apparatus 10 as a whole from one side of the truck to the other side of the truck.

When the bracket 78 is disconnected by the plate 90 by loosening the nut 93, the whole apparatus 10 may be wheeled backwardly and around the rear of the truck bed and fastened to one of the other mounting plates on the carriage 85. In some instances, it may be desirable to reverse the entire apparatus 10 and connect the bracket 78 on to the front side mounting panel 91 so that in order to move the gripper wheels in their retrieval mode, the truck will be operated in a reverse direction. Some drivers prefer this mode of operation and it can be accommodated with this apparatus.

An additional aid in the retrieval operation is a tip-up panel 99 mounted on a rod 100 extending downwardly below the front portion of the wheels 17, 18 and adjacent the front portion of the marker conveying space 21. The small panel 99 is connected to a handle 101 and is movable upwardly and downwardly by operating the swingable handle 101. The tip-up panel 99 is useful when the operator sees a marker lying on the pavement with the nose facing rearwardly instead of forwardly. The small panel 99 is lowered by operating the handle to engage the flange of the marker which is facing in the wrong direction, and when the flange of the marker lying on the pavement engages the small panel 99, the marker will flip over and then the marker will be picked up in the usual way by the gripper wheels 17, 18.

It will be seen that in addition to the novel apparatus devised according to the present invention, a novel method of handling highway warning markers has been devised, comprising engaging opposite side edges of a marker base flange and applying pressure to squeeze said edges toward each other, and subsequently manipulating the markers by the flanges. The markers are most often tilted onto one edge of the base flange prior to the step of engaging the edges of the flanges for applying pressure; and in most cases, the marker is tilted entirely onto its side so that the flange is nearly upright.

The method steps of engaging and manipulating the marker by its base flange are peformed by a pair of wheels rolling along the highway surface at opposite side edges of the base flange and at distances apart less than the spacing between the upright edges of the base flange. The lifting and manipulating steps are performed by the wheels upon a mobile medium traveling along the highway in a certain direction and orienting the tilted marker prior to the engaging and manipulating steps as to orient the base flange transversely of the direction of the travel. The manipulating step is followed by a releasing step which is performed by a cam-shaped stripper bar engaging the base flange and urging the flange and marker towards the outer peripheries of the wheels, and the releasing is also assisted by a flange guide at a peripheral portion of the wheels and also engaging the base flange as the marker is lifted to guide and prevent release of a flange until the marker reaches the upper portions of the wheels. In the dispensing mode, the manipulating step directs the base flange downwardly into engagement with the highway surface, and a bearing down on the marker flange stabilizes the marker as the flange engages the highway pavement.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. An apparatus for traveling forwardly along a highway to alternately dispense and retrieve highway warning markers having base flanges, comprising a pair of revolving gripper wheels to roll along highway pavement spaced from each other and defining marker conveying space therebetween, the wheels comprising central portions and edge portions and gripping portions between the central and edge portions for engaging the edges of marker base flanges, an in-feed chute mounted forwardly of the wheels and comprising a bumper portion spaced above the highway pavement to tip such markers onto their side and to pass over the upright base flanges of the tipped markers, the chute also comprising upright side panels guiding tipped markers on the pavement to orient the base flanges transversely of the gripper wheels, a pair of stationary spiral stripper bars in the marker conveying space adjacent the wheels and extending upwardly from the central portions of the wheels and forwardly across the gripping and edge portions to engage the base flanges and guide the markers out of the conveying space, a peripherally extending guide panel rearwardly of the marker conveying space and extending circumferentially upwardly around a portion of the edge portions of the wheels, the guide panel being in obstructing relation to radial removal of the markers from the conveying space, a lower portion of the guide panel being movable out of said obstructing relation, a stationary marker loading magazine at a forward side of the wheels and traversing the marker conveying space between the edge portions of the wheels, and a pair of stationary and removable elongate marker stabilizing guides extending between the wheels and along the highway pavement to pass over marker base flanges on the pavement, the stabilizing guide comprising upwardly inclined forward ends to engage and tip down the marker base flanges.

2. An apparatus according to claim 1 wherein a frame portion has anchoring means for mounting on a bed of a highway truck, the frame portion being tiltable upwardly to lift the gripper wheels to the truck bed, and hydraulic cylinder means for lifting the wheels.

3. An apparatus according to claim 2 wherein said anchoring means comprises a track to be affixed to the truck bed, a carriage on the track and movable therealong to protrude beyond an end of the track and beyond the truck bed, the carriage comprising an attachable means detachably connected to said tiltable frame portion.

4. An apparatus according to claim 3 wherein the carriage comprises opposite ends for alternate protruding beyond the end of the track and beyond the truck bed, said attachment means being at opposite ends of the carriage for connecting to the frame portion adjacent either end of the track and at either side of the truck bed.

5. An apparatus according to claim 4 wherein each end of the carriage comprises front and rear sides facing to a front and rear of the truck bed, and said attachment means being at each of said front and rear sides of the carriage for mounting the frame portion.

6. An apparatus according to claim 1 wherein said lower portion of the guide panel is hinged to swing upwardly and away from the wheels to let the revolving wheels roll away from markers standing on the pavement.

7. An apparatus according to claim 1 wherein the stationary stripper bar extends obliquely across the gripping and edge portions of the wheels.

8. An apparatus according to claim 1 wherein the in-feed chute is removably mounted.

9. An apparatus according to claim 1 wherein the gripper wheels also comprise peripheral tires rolling directly upon the highway pavement.

* * * * *